US007843336B2

(12) United States Patent
Kucharyson

(10) Patent No.: US 7,843,336 B2
(45) Date of Patent: Nov. 30, 2010

(54) SELF-CONTAINED WIRELESS SECURITY SENSOR COLLECTIVE SYSTEM AND METHOD

(75) Inventor: Richard P. Kucharyson, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 343 days.

(21) Appl. No.: 11/729,285

(22) Filed: Mar. 28, 2007

(65) Prior Publication Data

US 2008/0238651 A1 Oct. 2, 2008

(51) Int. Cl.
*G08B 21/00* (2006.01)

(52) U.S. Cl. ..... 340/540; 340/539.22

(58) Field of Classification Search ..... 340/506, 340/508, 539.22, 540, 541
See application file for complete search history.

(56) References Cited

U.S. PATENT DOCUMENTS

| | | | | |
|---|---|---|---|---|
| 5,713,050 | A | 1/1998 | Ozawa | |
| 6,970,183 | B1 * | 11/2005 | Monroe | 348/143 |
| 7,035,313 | B2 | 4/2006 | Fry | |
| 7,139,218 | B2 | 11/2006 | Hall et al. | |
| 7,296,286 | B2 | 11/2007 | Osawa | |
| 7,298,964 | B2 | 11/2007 | Ishikawa et al. | |
| 7,502,546 | B2 | 3/2009 | Elberbaum | |
| 2002/0147982 | A1 | 10/2002 | Naidoo et al. | |
| 2002/0186710 | A1 | 12/2002 | Alvesalo et al. | |
| 2003/0086000 | A1 | 5/2003 | Siemens et al. | |
| 2004/0004542 | A1 | 1/2004 | Faulkner et al. | |
| 2005/0275532 | A1 * | 12/2005 | Ferri et al. | 340/539.26 |
| 2006/0095539 | A1 * | 5/2006 | Renkis | 709/217 |
| 2006/0143671 | A1 | 6/2006 | Ens et al. | |
| 2006/0187017 | A1 * | 8/2006 | Kulesz et al. | 340/506 |
| 2006/0253885 | A1 | 11/2006 | Murphy et al. | |
| 2007/0003146 | A1 | 1/2007 | Ko et al. | |

FOREIGN PATENT DOCUMENTS

WO WO 02/30108 A1 4/2002

OTHER PUBLICATIONS

International Search Report dated Oct. 7, 2008 in connection with PCT Application No. PCT/US2008/058539.
Written Opinion of the International Searching Authority dated Sep. 28, 2009 in connection with PCT Application No. PCT/US2008/058539.

* cited by examiner

*Primary Examiner*—George A Bugg
*Assistant Examiner*—Kerri McNally
(74) *Attorney, Agent, or Firm*—Munck Carter, LLP

(57) ABSTRACT

A system includes a plurality of sensors and a monitoring system that are capable of wireless communication. A first of the sensors senses information relating to a specified condition and sends a wireless message with information relating to the specified condition to a second of the sensors. The first sensor also sends another wireless message relating to the specified condition to the monitoring system. The second sensor may also sense information relating to the specified condition, and the message sent to the monitoring system may include information derived from the information sensed by both the sensors. The second sensor may modify its functionality in response to the wireless message sent by the first sensor.

20 Claims, 4 Drawing Sheets

SELF-CONTAINED WIRELESS SECURITY SENSOR COLLECTIVE SYSTEM AND METHOD

CROSS REFERENCE TO RELATED APPLICATIONS

This patent application is related to U.S. patent application Ser. No. 11/729,215 entitled "MESH COMMUNICATION WIRELESS CAMERA SYSTEM AND METHOD" filed on Mar. 28, 2007, which is incorporated by reference.

TECHNICAL FIELD

This disclosure relates generally to security sensors and more specifically to a self-contained wireless security sensor collective system and method.

BACKGROUND

One of the top priorities at an industrial facility is security. Perimeter security, access controls, and communication systems may be elements of a security system at an industrial facility.

Sensors in a security system may include cameras, access readers and motion sensors. However, the costs of installing cables and wires to such sensors for power and data communications are generally high. Such costs may serve as a disincentive to an industrial facility owner to operate an effective security monitoring and alarm system.

Some industrial facilities and other commercial facilities have miles of perimeter to monitor, and security cameras may be required every 100 to 200 feet along the perimeter. Thus, 25 to 50 security cameras, along with associated power and data cables and trenches in which to install the cables, may be required for every mile of facility perimeter.

Motion sensors may also be installed in quantities proportional to the size of a facility perimeter being monitored. Access readers may be required on portals in the perimeter of a facility as well as on doors and gates at locations within the facility.

Furthermore, monitoring such a multitude of sensors may require a complex monitoring system. Data from each sensor may be routed to a single control center for monitoring and alarm generation. Both human and equipment costs for such monitoring may be high. As a result, current security monitoring systems may have high installation costs and monitoring costs when used in an industrial facility.

SUMMARY

This disclosure provides a self-contained wireless security sensor collective system and method.

In a first embodiment, a system includes a plurality of sensors and a monitoring system. The sensors and the console are capable of wireless communication. A first of the sensors is operable to sense information relating to a specified condition and to send a first wireless message relating to the sensed information to a second of the sensors. The first sensor is also operable to send a second wireless message relating to the sensed information to the monitoring system.

In particular embodiments, the second sensor is also operable to sense information relating to the specified condition, and the message sent to the monitoring system includes information derived from the information sensed by both the first and second sensors.

In other particular embodiments, the second sensor may modify its functionality in response to the first wireless message.

In a second embodiment, a sensor includes a sensor device, a wireless communication device and a controller. The controller is operable to receive information relating to a specified condition via the sensing device. The controller is further operable to send a first wireless message to a second sensor via the wireless interface, where the first wireless message relates to the sensed information. The controller is also operable to send a second wireless message to a monitoring system via the wireless interface, where the second wireless message also relates to the sensed information.

In a third embodiment, a method includes sensing information relating to a specified condition with a first sensor of a plurality of sensors that are capable of wireless communication. The method also includes sending a first wireless message relating to the sensed information from the first sensor to a second of the sensors. The method further includes sending a second wireless message relating to the sensed information to a monitoring system that is capable of wireless communication.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1:
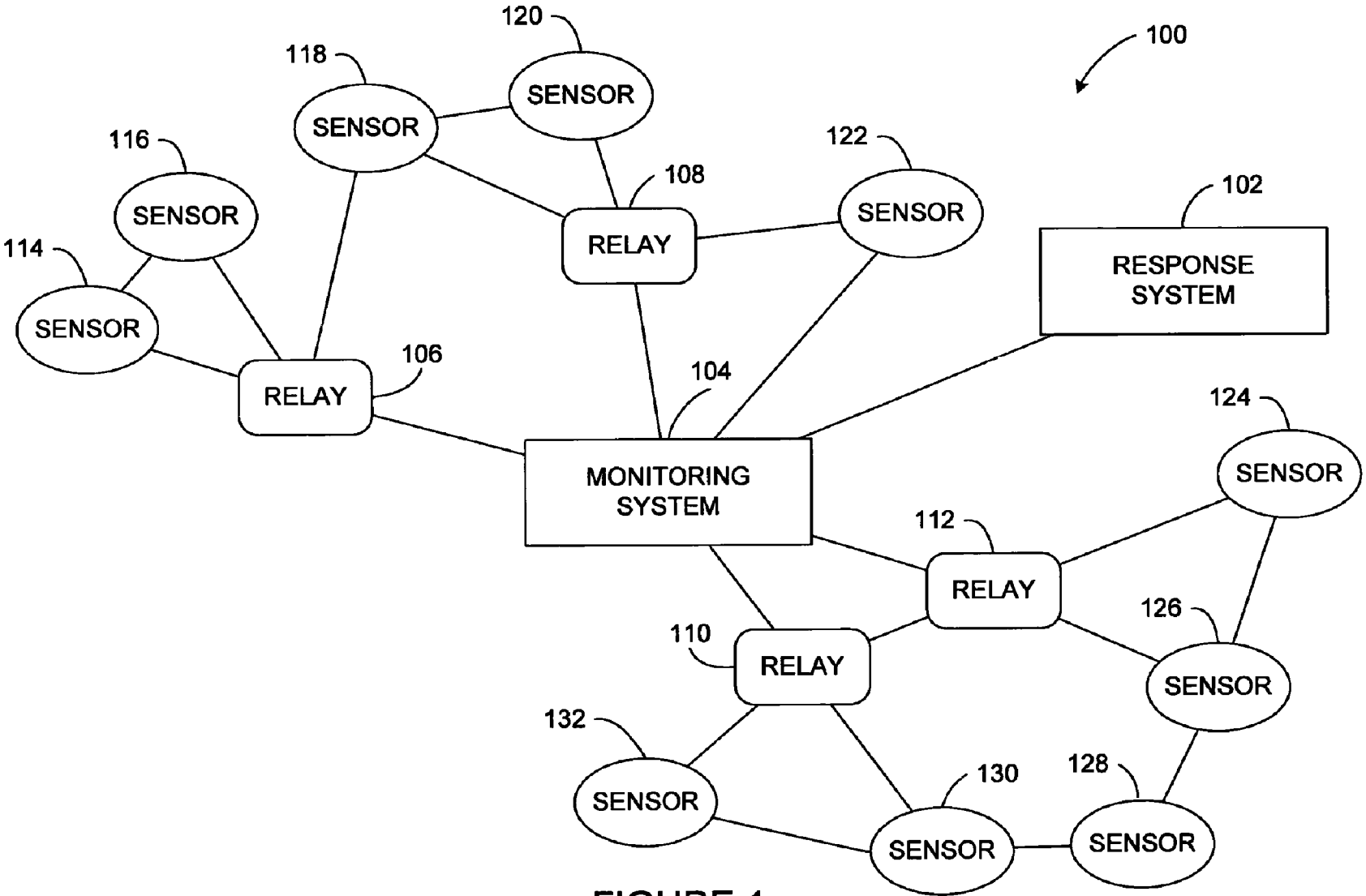
FIG. 1 illustrates an example wireless security sensor system according to one embodiment of this disclosure.

FIG. 1 illustrates an example wireless security sensor system 100 according to one embodiment of this disclosure. The embodiment of the wireless security sensor system 100 shown in FIG. 1 is for illustration only. Other embodiments of the wireless security sensor system 100 could be used without departing from the scope of this disclosure.

In this example embodiment, the wireless security sensor system 100 could be used in any suitable type of security monitoring application. For example, the wireless security sensor system 100 could be used in a building, an industrial facility or an urban environment. Although the wireless security sensor system 100 may be described below as being used in an industrial facility, the wireless security sensor system 100 could be used in any of these or other environments. Also, although the wireless security sensor system 100 may be described below as being used to detect physical invasion, the wireless security sensor system 100 may be used to detect fire, machine failure, process failures and other alarm conditions.

In addition, the wireless security sensor system 100 could use any suitable wireless signals to communicate. Although the wireless security sensor system 100 may be described below as using radio frequency (RF) signals to communicate, the wireless security sensor system 100 could use any other or additional type of wireless signal.

As shown in FIG. 1, the wireless security sensor system 100 includes a response system 102. In some embodiments, the response system 102 may include an operator console that may be monitored by an operator. The operator may respond to security alarms reported at the operator console. Such responses may include dispatching security personnel to the area of the security breach and shutting down industrial processes in the area of the process failure. In other embodiments, the response system may be a security system that dispatches security personnel automatically in response to a security alarm. In yet other embodiments, the response system 102 may be an industrial process control system that responds to a security alarm by, for example, emptying a tank that may be under attack or shutting down a pump feeding a section of pipeline that is under attack.

The response system 102 may be in wired or wireless communication with a monitoring system 104 that performs alarm analysis on, and routes signals received from, sensors in the environment being monitored. The monitoring system 104 may analyze reports received from sensors to sense an alarm condition and report on that condition to the response system 102. Where the sensors include cameras, the monitoring system 104 may route all or selected video signals received from sensors to the response system 102.

The wireless security sensor system 100 may be configured as a wireless mesh communication system. Sensors 114-132 may communicate with each other and with relay devices 106-112, as well as directly with the monitoring system 104. Such wireless links between nodes of the wireless security sensor system 100 may be formed at system configuration. Also, a routing map may be created indicating pathways to be used for sending a wireless message from one sensor to another or from a sensor to the monitoring system 104.

The initial ability of one node to establish a wireless link to another node may be affected by distance between nodes, intervening structures or geographical features that interfere with wireless signals, or other factors. Such factors affecting wireless communication may change, permanently or temporarily, during operation of the wireless security sensor system 100, causing previously operable wireless links to degrade or fail. In the event of such failures, the wireless security sensor system 100 may route a wireless message by an alternate path to avoid degraded or failed links.

As shown in FIG. 1, in the example wireless security sensor system 100 the sensors 114 and 116 are able to communicate wirelessly with each other and with the relay device 106, which is able to communicate wirelessly with the monitoring system 104. The sensor 118 is able to communicate wirelessly with the relay devices 106 and 108 and with the sensor 120, which is able to communicate wirelessly with the relay device 108. The sensor 122 is able to communicate wirelessly with the relay device 108, and both the sensor 122 and the relay device 108 are able to communicate wirelessly with the monitoring system 104.

The sensor 124 is able to communicate wirelessly with the relay device 112 and the sensor 126, which is also able to communicate wirelessly with the relay device 112. The sensor 128 is able to communicate only with the sensors 126 and 130. The sensor 130 is further able to communicate with the relay device 110 and the sensor 132, which is also able to communicate wirelessly with the relay device 110. The relay devices 110 and 112 can also communicate wirelessly with the monitoring system 104.

As such, subsets of the sensors 114-132 and the relay devices 106-112 of the wireless security sensor system 100 may collect information and perform analysis on a particular security threat or alarm condition by communicating only with each other. In this way, communication bandwidth may be utilized in only the portion of the network that enables the subset of sensors and relay devices to communicate with each other. Communication bandwidth in other portions of the wireless security sensor system 100 may be left free for other purposes. Furthermore, where some of the sensors 114-132 are video cameras, real-time video from only selected cameras may be routed back to an operator to reduce demands on the bandwidth of central links of the communication system, although real-time video from all cameras may be routed to the operator.

Figure 2:
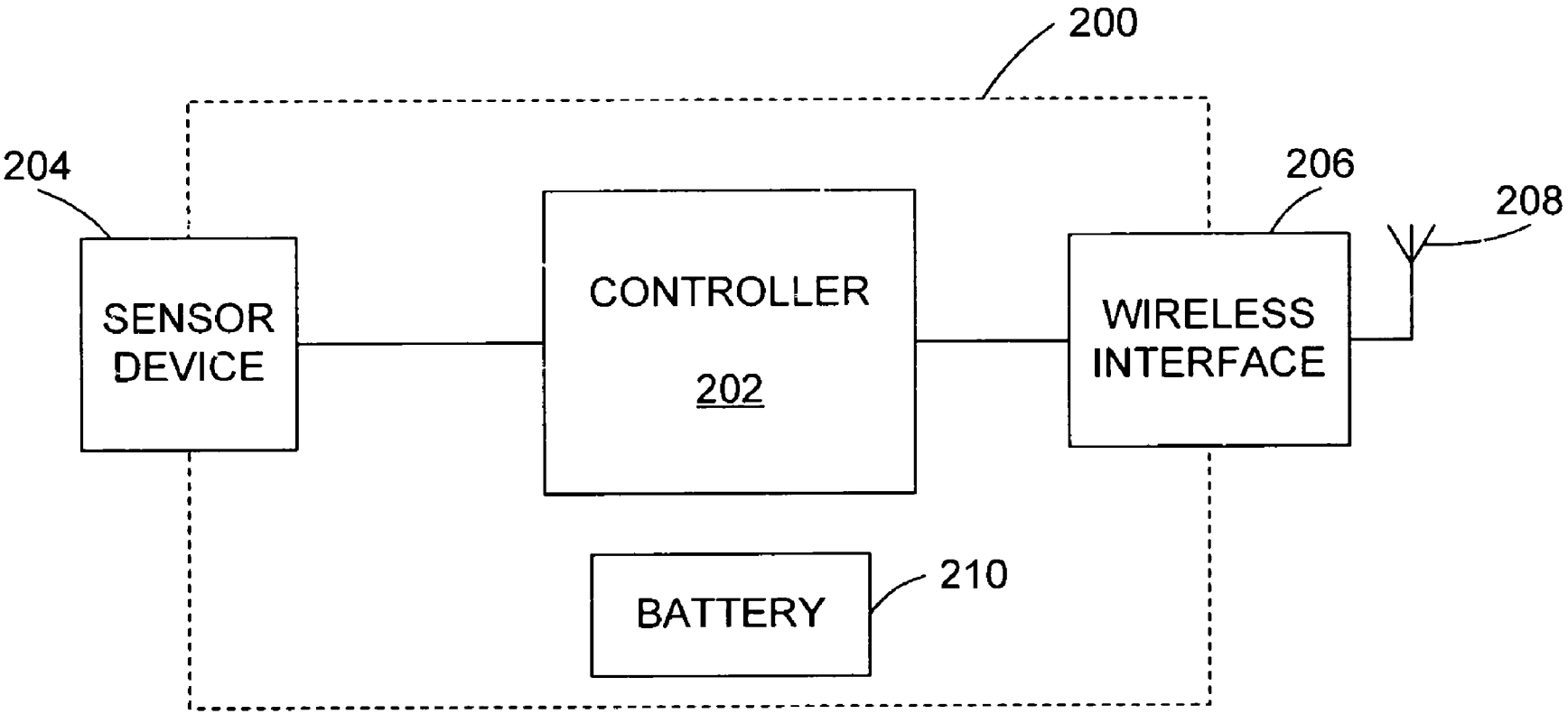
FIG. 2 illustrates an example sensor according to one embodiment of this disclosure.

FIG. 2 illustrates an example sensor 200 according to one embodiment of this disclosure. The embodiment of the sensor 200 shown in FIG. 2 is for illustration only. Other embodiments of the sensor 200 could be used without departing from the scope of this disclosure.

In this example, the sensor 200 includes a sensor device 204, a controller 202 and a wireless interface 206. A battery 210 may power the components of the sensor 200.

In some embodiments, the sensor device 204 may be a video camera. In other embodiments, the sensor device 204 may be a motion detector. In yet other embodiments, the sensor device 204 may be an access device, such as a proximity detector, a biometric scanner, a magnetic stripe or barcode reader, or a keypad. The sensor device 204 could also represent a combination of these or other devices.

The controller 202 is coupled to the sensor device 204 and receives signals corresponding to information sensed by the sensor device 204, which relates to the environment in which the sensor device 204 is operating. The controller 202 may analyze the signals in order to detect certain specified conditions. For example, in some embodiments, the sensor device 204 may be an access device and the controller 202 may analyze the sensed information to detect the opening of a door or gate without the proper authorization device being presented. In other embodiments, the sensor device 204 may be a video camera and the controller 202 may analyze the video signal to detect the presence of an intruder or to detect a failure of the camera or interference with the proper operation of the camera. Failure conditions of a camera may include information relating to the charge status of the battery 210 or self-testing diagnostic programs executed by the controller 202.

The controller 202 is also coupled to the wireless interface 206. Having detected a threat to the facility being monitored or to the proper operation of the security system, the controller 202 may send a message relating to the sensed information via the wireless interface 206. The wireless interface 206 may transmit an RF or other signal via an antenna 208 to another sensor, a relay device or a monitoring system.

Figure 3:
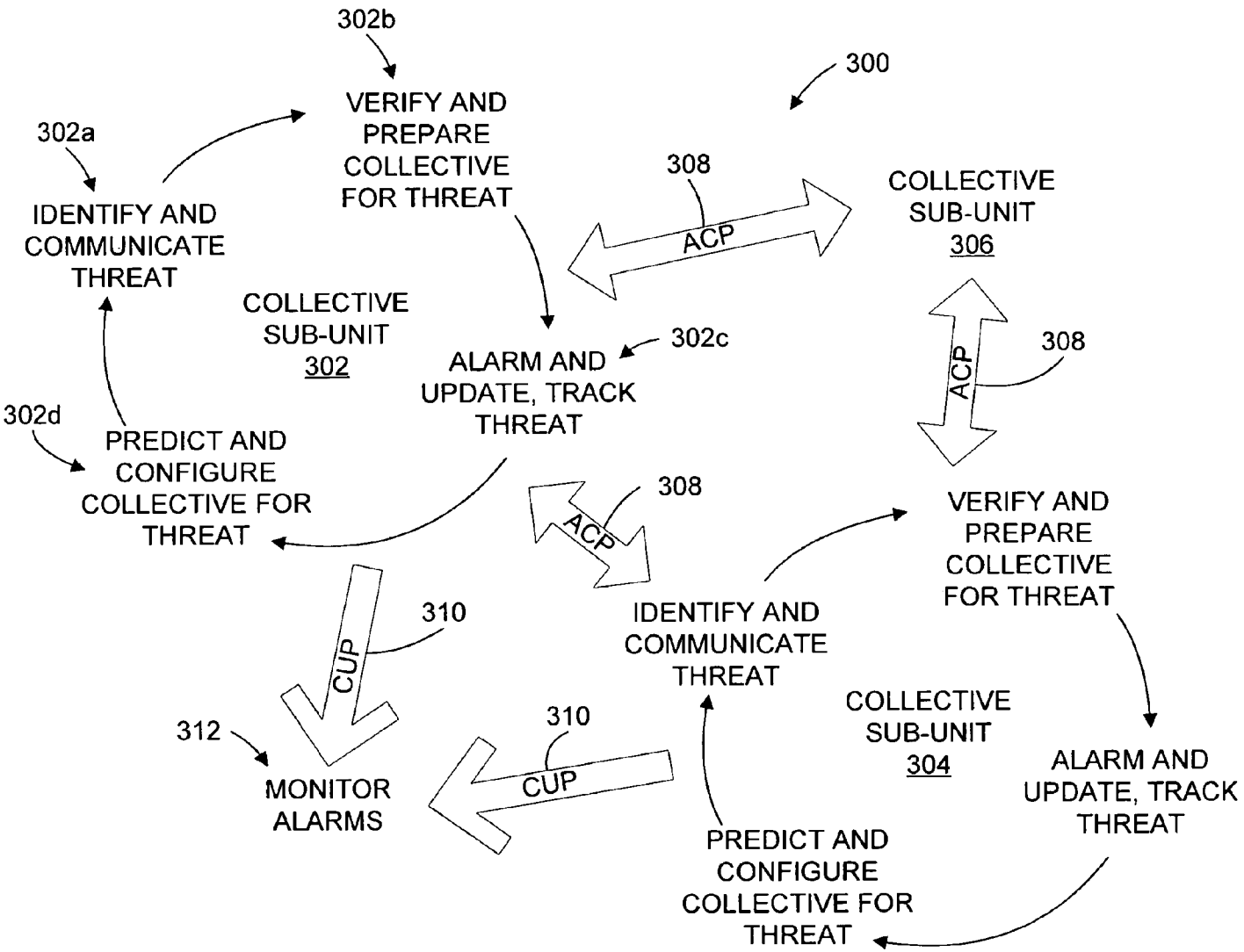
FIG. 3 illustrates example actions performed by an example wireless security sensor system according to one embodiment of this disclosure.

FIG. 3 illustrates example actions 300 performed by the example wireless security sensor system 100 according to one embodiment of this disclosure. More specifically, FIG. 3 depicts a situation where the sensors 114-132 and the relay devices 106-112 have organized themselves, in a manner to be explained below, into three subsets. While FIG. 3 shows three subsets, it will be understood that the sensors 114-132 and relay devices 106-112 may organize themselves into more or fewer subsets, as required to track threats detected by the wireless security sensor system 100. The subsets are referred to in FIG. 3 as collective sub-units 302, 304 and 306. The collective sub-units (or collectives) 302-306 may comprise components of the wireless security sensor system 100 that are located in geographically separate areas of an industrial facility being monitored. The components in the collective 302 may or may not be different components than those in the collective 304, which may or may not both be different than the components in the collective 306.

With reference to the elements of FIGS. 1 and 2, in step 302*a*, the sensor 116 may identify a threat in the information that its sensor device 204 senses. Also in step 302*a*, the sensor 116 may communicate with the sensors 114 and 118 and the rely device 106 to organize the collective sub-unit 302. In step 302*b*, the components of the collective 302 may further communicate with each other to verify the threat detected by the sensor 116 and to condition the functionality of the sensors 114-118 and the relay device 106 for further analysis of the threat. Such changes to the functionality of a sensor or relay device may include, among others, adjusting a sensitivity of a sensor to improve its ability to sense the threat, loading an analysis program into a sensor or relay device, and reorienting a camera capable of pan/tilt/zoom adjustment to improve its image of the threat.

Having verified and further analyzed the threat, in step 302*c* the collective 302 may send an alarm message to the monitoring system 104 or update a previously sent alarm. Also in step 302*c*, the collective 302 may continue to track and analyze the threat. In step 302*d*, the collective sub-unit may predict a future development in the status of the threat and configure itself to continue tracking the threat, for example by adding another sensor to the collective 302. The collective 302 may then return to step 302*a*, step 302*b* or step 302*c*.

The sensors and relay devices within a collective sub-unit and in different collective sub-units may exchange messages 308 in a first communication protocol referred to as an Artificial Collaborative Protocol (ACP). Such a protocol may include messages for use in mustering sensors and relay devices into a collective, communicating the identity of a threat, verifying a threat, and communicating desired functionality for a sensor or relay device.

The components of a collective sub-unit may send messages 310 to the monitoring system using a second communication protocol to communicate the components' status and the status of a threat. Such a protocol may be referred to as a Collective to User Protocol (CUP). Such a protocol may include messages for reporting a threat, transmitting real-time or compressed video, transmitting still images, and conditioning the response of a collective to a threat.

Figure 4:
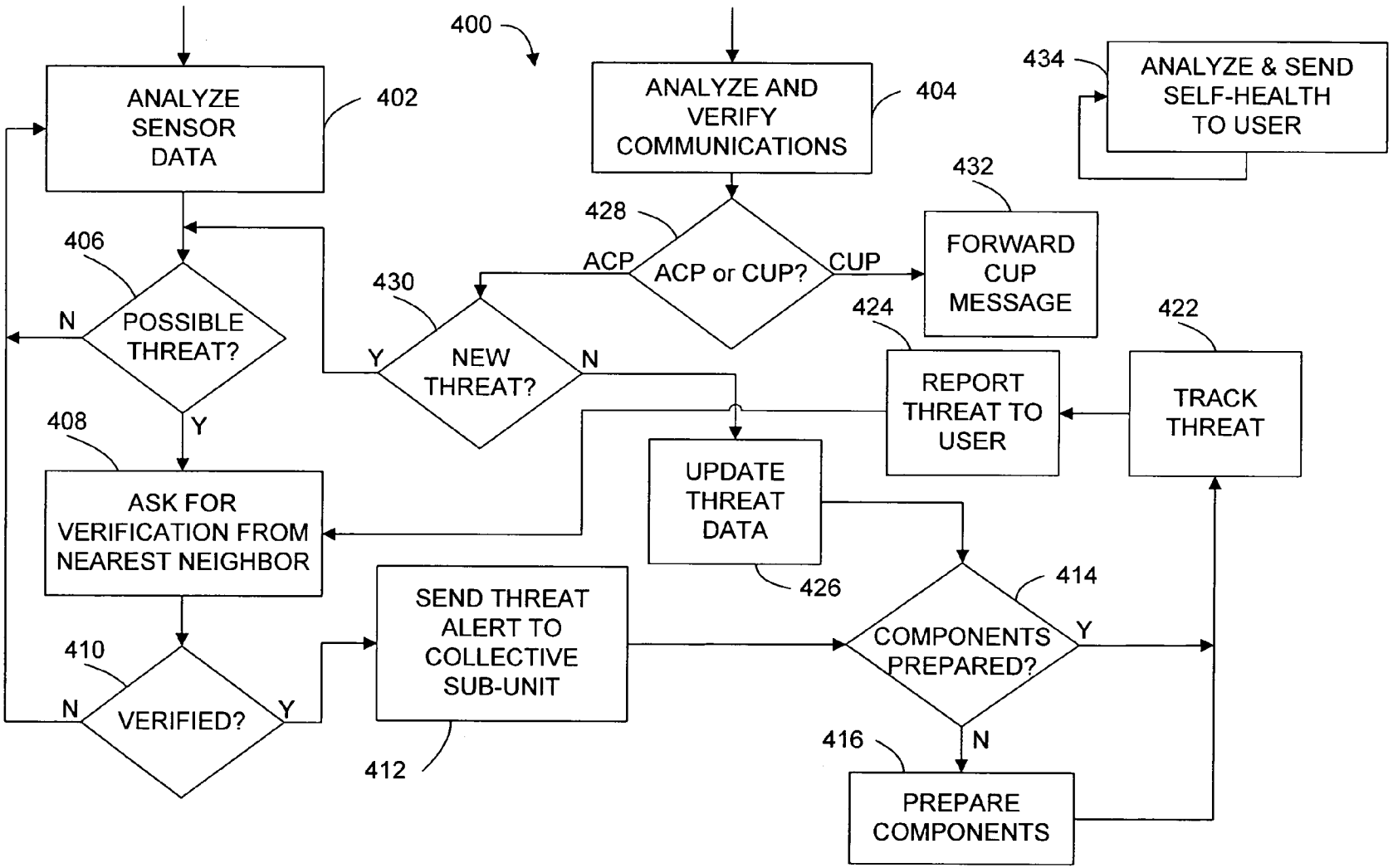
FIG. 4 illustrates example actions performed by a group of system components according to one embodiment of this disclosure.

FIG. 4 illustrates example actions 400 performed by a collective sub-unit according to one embodiment of this disclosure. This description uses the sensor 116 for illustrative purposes, although it will be understood that some or all of the actions 400 may be performed by any of the sensors 114-132 in the wireless security sensor system 100. Also, any of the relay devices 106-112 may contribute to the analysis process of a collective sub-unit by performing any of the actions 400 that do not involve sensing the environment.

The sensor 116 may obtain and analyze sensor data at step 402 for specified conditions indicating a threat. If the analysis does not indicate a possible threat in step 406, the sensor 116 may return to step 402 to obtain and analyze further sensor data. If a possible threat is indicated in step 406, the sensor 116 may consult a geographical map of the environment it is sensing to determine a geographical direction of the possible threat and identify a second sensor (for example, the sensor 114) that is nearest to the sensor 116 in that direction. Having identified the sensor 114, the sensor 116 may then send a wireless message to the sensor 114 using the ACP protocol, requesting that the sensor 114 verify the possible threat at step 408. The sensor 114 may analyze its own sensor information or may perform additional analysis processing to provide the requested verification to the sensor 116.

In step 410, if the sensor 116 receives a reply message in the ACP protocol indicating that the sensor 114 has not verified the possible threat, the sensor 116 may return to step 402 to obtain and analyze further sensor data. If the sensor receives a message in step 410 that indicates that the sensor 114 has verified the possible threat, then in step 412 the sensor 116 may further consult the map and identify some elements of a collective sub-unit to be mustered for use in tracking the threat. The sensor 116 may select candidates for membership in the collective based upon the geographical location of sensors, the processing capabilities of sensors or relay devices, or other criteria.

Further, in step 412, the sensor 116 may send one or more wireless messages using the ACP protocol to the candidate sensors and relay devices to form the collective sub-unit. In step 414, the sensor 116 may send further messages using the ACP protocol to the components of the collective to determine whether they are prepared for tracking the threat. If the sensor 116 determines in step 414 that one or more components are not prepared, then in step 416 the sensor 116 may send further messages using the ACP protocol to cause the unprepared components to prepare themselves for tracking the threat.

Whether the components of the collective sub-unit are already prepared in step 414 or have been prepared in step 416, in step 422 the sensor 116 may send further messages in the ACP protocol to initiate tracking of the threat by the collective. In step 424, a component of the collective may send one or more messages to the monitoring system 104 using the CUP protocol to report the threat to a user of the wireless security sensor system 100. The messages may report information such as detection of the threat, a location of the threat, a threat level of the threat, still images of the threat, a video clip of the threat and real-time video of the threat. The messages may multiplex video signals from selected sensors of the collective for the operator console by switching periodically between the video signals from the selected sensors. The sensor 116 may then return to step 408 to continue the process of participating in the collective's tracking of the threat.

In some embodiments, in step 414, the collective sub-unit may determine its components' preparedness to track a moving threat. The sensor 116 may analyze its sensor information to determine whether the threat is moving. If not, the collective may move on to tracking the threat in step 422. If the threat is determined to be moving in step 414, a component of the collective may consult a geographical map including information regarding the orientation of the sensor 116 and its area of coverage to determine a direction in which the threat is moving. The component may further consult the map to identify a sensor whose area of coverage is in the direction that the threat is moving, such as the sensor 118.

The sensor 118 may then determine whether it is ready to track the threat moving in the determined direction from its present position. If the sensor 118 determines that it is prepared to track the moving threat, then the collective may move on to tracking the threat in step 422. However, if the sensor 118 determines that it is not ready to track the threat in step 414, the sensor 118 may prepare itself in step 416 by actions such as reorienting its field of view by panning, tilting or zooming. It may thus obtain a position in which it will be able to sense the threat when the threat moves into the field of view of the sensor 118.

In other embodiments, in step 414 the collective sub-unit may determine whether a component (for example the relay device 106) has an analytical program that it will need in tracking the threat. If so, then the collective may move on to tracking the threat in step 422. If not, the relay device 106 may load the program from another component of the collective or from a program repository coupled to the monitoring system 104. Once the program is loaded into the relay device 106, the collective may move on to step 422 and track the threat.

Concurrently with obtaining and analyzing sensor data, the sensor 116 may also await communications from other sensors or relay devices in step 404. A relay device or other component of a collective sub-unit may also perform this step, in order to participate in the analysis process of the collective. A received message may be checked in step 428 to determine whether it uses the ACP protocol or the CUP protocol. If the message uses the ACP protocol, it may be checked in step 430 to determine whether it relates to a new threat. If the message relates to a new threat, the sensor 116 may begin processing the threat by verifying the threat in step 406. If the threat is not a new threat, the sensor 116 may continue tracking the threat by updating its threat data in step 426. Updating the threat data in step 426 may include adding or deleting components to the collective. The collective may again determine, in step 414, whether the components of the collective sub-unit are prepared, in light of the updated threat data.

If a collective sub-unit component determines in step 428 that the received message uses the CUP protocol, the component will determine who the intended recipient of the message is. If the message is intended for the components of the collective, then at step 432 the component will comply with the message, as well as forwarding the message to other components of the collective. If the message is intended for the monitoring system 104 or another collective, the component will forward the message to the next node in a wireless communication path leading to the intended recipient.

In step 434, any node in the wireless security sensor system 100 may analyze its own self-health, whether or not currently a part of a collective sub-unit. This analysis may include assessing a charge level of the battery 210 or performing a diagnostic self-test of one or more components of the node. The node may send the results of the self-health analysis via a wireless message to the response system 102. A system operator may review such messages in the course of performing maintenance or preventive maintenance on the wireless security sensor system 100. Where the message indicates a low charge level on the battery 210, the maintenance may include replacing or recharging a conventional battery or replenishing the fuel in a fuel cell.

In some embodiments, various functions described above are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory.

It may be advantageous to set forth definitions of certain words and phrases used throughout this patent document. The term "couple" and its derivatives refer to any direct or indirect communication between two or more elements, whether or not those elements are in physical contact with one another. The terms "application" and "program" refer to one or more computer programs, software components, sets of instructions, procedures, functions, objects, classes, instances, related data, or a portion thereof adapted for implementation in a suitable computer code (including source code, object code, or executable code). The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "controller" means any device, system, or part thereof that controls at least one operation. A controller may be implemented in hardware, firmware, software, or some combination of at least two of the same. The functionality associated with any particular controller may be centralized or distributed, whether locally or remotely.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of the invention, as defined by the following claims.

What is claimed is:

1. A system comprising:

a plurality of sensors configured to communicate wirelessly;

a relay configured to communicate wirelessly, wherein the relay does not comprise a sensor; and a monitoring system configured to communicate with the sensors;

wherein:

a first sensor of the plurality of sensors is configured to sense information relating to a specified condition and send a first wireless message relating to the sensed information to a second sensor of the plurality of sensors;

the second sensor is configured to verify a possible threat associated with the specified condition and to notify the first sensor whether the possible threat has been verified;

at least one of the first and second sensors is configured, if the second sensor verifies the possible threat, to organize the first and second sensors along with one or more additional components into a collective sub-unit in the system;

the components in the collective sub-unit, including the first and second sensors, are configured to communicate and collectively track the verified threat; and at least one of the components in the collective sub-unit is configured to send a second wireless message relating to the verified threat to the monitoring system;

wherein the first sensor is configured to send the first wireless message using a first communication protocol, the first communication protocol defining a first set of messages for identifying the possible threat, verifying the possible threat, mustering components into the collective sub-unit, and identifying desired functionality for one or more of the components in the collective sub-unit;

wherein the at least one component in the collective sub-unit is configured to send the second wireless message using a second communication protocol, the second communication protocol defining a second set of messages for reporting the verified threat, transmitting video or still images associated with the verified threat, and conditioning a response of the collective sub-unit to the verified threat;

wherein the first set of messages is distinct from the second set of messages; and wherein the relay is configured to:

receive the second wireless message from the at least one component in the collective sub-unit and send the second wireless message to the monitoring system;

receive the first wireless message from the first sensor and join the collective sub-unit; and load and use an analysis program to track the verified threat.

2. The system of claim 1, wherein:

the second sensor is configured to sense information relating to the specified condition in order to verify the possible threat; and the second wireless message comprises information derived from the information sensed by both the first and second sensors.

3. The system of claim 1, wherein the second sensor is configured to modify its functionality in response to the first wireless message, wherein the modified functionality comprises at least one of:

adjusting a sensitivity of the second sensor to improve its ability to sense the possible threat;

loading an analysis program into the second sensor; and reorienting a camera associated with the second sensor to improve the camera's image of the possible threat.

4. The system of claim 1, wherein the first sensor is configured to select the second sensor from the plurality of sensors according to stored information relating to an environment being sensed.

5. The system of claim 4, wherein the stored information comprises information relating to geographical positions of the first and second sensors and geographical regions of the environment sensed by the first and second sensors.

6. The system of claim 1, further comprising:

a response system coupled to the monitoring system, the response system comprising a process control system operable to adjust operation of an industrial system based on the verified and tracked threat.

7. The system of claim 1, wherein the relay is configured to send the second wireless message to the monitoring system via a plurality of wireless links.

8. A sensor comprising:

a first sensing device;

a wireless communication interface; and a controller configured to:

receive information relating to a specified condition via the first sensing device;

send a first wireless message to a second sensor via the wireless interface, the first wireless message relating to the sensed information;

receive an indication from the second sensor indicating whether the second sensor has verified a possible threat associated with the specified condition;

if the second sensor verifies the possible threat, organize the sensors along with one or more additional components into a collective sub-unit in a system;

cooperate with the other components in the collective sub-unit to collectively track the verified threat; and send a second wireless message to a monitoring system via the wireless interface, the second wireless message relating to the verified threat;

wherein the controller is configured to send the first wireless message using a first communication protocol, the first communication protocol defining a first set of messages for identifying the possible threat, verifying the possible threat, mustering components into the collective sub-unit, and identifying desired functionality for one or more of the components in the collective sub-unit;

wherein the controller is configured to send the second wireless message using a second communication protocol, the second communication protocol defining a second set of messages for reporting the verified threat, transmitting video or still images associated with the verified threat, and conditioning a response of the collective sub-unit to the verified threat;

wherein the first set of messages is distinct from the second set of messages; and wherein the controller is configured to receive communications from a third sensor and join a second collective sub-unit concurrently with any of: the receiving of the information, the sending of a first wireless message, the receiving of the indication, the organizing, the cooperating, and the sending of the second wireless message, the second collective sub-unit comprising components configured to track a second threat.

9. The sensor of claim 8, wherein:

the controller is further configured to receive a third wireless message via the wireless interface indicating whether the second sensor has verified the possible threat; and the second wireless message comprises information derived from information sensed by both the sensors.

10. The sensor of claim 8, wherein the first wireless message is configured to cause the second sensor to modify its functionality, wherein the modified functionality comprises at least one of:

adjusting a sensitivity of the second sensor to improve its ability to sense the possible threat;

loading an analysis program into the second sensor; and reorienting a camera associated with the second sensor to improve the camera's image of the possible threat.

11. The sensor of claim 8, wherein the controller is further configured to select the second sensor from a plurality of sensors according to stored information relating to an environment being sensed, wherein the stored information comprises information relating to geographical positions of the sensors and geographical regions of the environment sensed by the sensors.

12. The sensor of claim 8, wherein the wireless communication interface is configured to send the second wireless message to the monitoring system via a plurality of wireless links.

13. A sensor comprising:

a first sensing device;

a wireless communication interface; and a controller configured to:

receive information relating to a specified condition via the first sensing device;

send a first wireless message to a second sensor via the wireless interface, the first wireless message relating to the sensed information;

receive an indication from the second sensor indicating whether the second sensor has verified a possible threat associated with the specified condition;

if the second sensor verifies the possible threat, organize the sensors along with one or more additional components into a collective sub-unit in a system;

cooperate with the other components in the collective sub-unit to collectively track the verified threat; and send a second wireless message to a monitoring system via the wireless interface, the second wireless message relating to the verified threat;

wherein the controller is configured to send the first wireless message using a first communication protocol, the first communication protocol defining a first set of messages for identifying the possible threat, verifying the possible threat, mustering components into the collective sub-unit, and identifying desired functionality for one or more of the components in the collective sub-unit;

wherein the controller is configured to send the second wireless message using a second communication protocol, the second communication protocol defining a second set of messages for reporting the verified threat, transmitting video or still images associated with the verified threat, and conditioning a response of the collective sub-unit to the verified threat;

wherein the first set of messages is distinct from the second set of messages;

wherein the controller is further configured to receive a third wireless message via the wireless interface indicating whether the second sensor has verified the possible threat;

wherein the second wireless message comprises information derived from information sensed by both the sensors; and wherein the wireless communication interface is configured to send the second wireless message to the monitoring system via a relay that is configured to communicate wirelessly, wherein the relay does not comprise a sensor and is configured to receive the first message from the sensor and to join the collective sub-unit.

14. A method comprising:

sensing information relating to a specified condition at a first sensor of a plurality of sensors configured to communicate wirelessly;

sending a first wireless message relating to the sensed information from the first sensor to a second sensor of the plurality of sensors;

receiving an indication from the second sensor at the first sensor indicating whether the second sensor has verified a possible threat associated with the specified condition;

if the second sensor verifies the possible threat, transmitting messages from the first sensor to organize the first and second sensors along with one or more additional components into a collective sub-unit in a system;

cooperating with the other components in the collective sub-unit to collectively track the verified threat;

sending a second wireless message relating to the verified threat to a monitoring system;

receiving at the first sensor a communication from a third sensor;

causing the first sensor to join a second collective sub-unit; and cooperating with other components in the second collective sub-unit to collectively track a second threat;

wherein the first wireless message is sent using a first communication protocol, the first communication protocol defining a first set of messages for identifying the possible threat, verifying the possible threat, mustering components into the collective sub-unit, and identifying desired functionality for one or more of the components in the collective sub-unit;

wherein the second wireless message is sent using a second communication protocol, the second communication protocol defining a second set of messages for reporting the verified threat, transmitting video or still images associated with the verified threat, and conditioning a response of the collective sub-unit to the verified threat;

wherein the first set of messages is distinct from the second set of messages.

15. The method of claim 14, further comprising sensing information relating to the specified condition at the second sensor in order to verify the threat, wherein the second wireless message comprises information derived from the information sensed by both the first and second sensors.

16. The method of claim 14, further comprising modifying the functionality of the second sensor in response to the first wireless message, wherein the modified functionality comprises at least one of:

adjusting a sensitivity of the second sensor to improve its ability to sense the possible threat;

loading an analysis program into the second sensor; and reorienting a camera associated with the second sensor to improve the camera's image of the possible threat.

17. The method of claim 14, further comprising selecting the second sensor from the plurality of sensors according to stored information relating to an environment being sensed, wherein the stored information comprises information relating to geographical positions of the first and second sensors and geographical regions of the environment sensed by the first and second sensors.

18. The method of claim 14, wherein sending the second wireless message further comprises sending the second wireless message via a plurality of wireless links.

19. A method comprising:

sensing information relating to a specified condition at a first sensor of a plurality of sensors configured to communicate wirelessly;

sending a first wireless message relating to the sensed information from the first sensor to a second sensor of the plurality of sensors;

receiving an indication from the second sensor at the first sensor indicating whether the second sensor has verified a possible threat associated with the specified condition;

if the second sensor verifies the possible threat, transmitting messages from the first sensor to organize the first and second sensors along with one or more additional components into a collective sub-unit in a system;

cooperating with the other components in the collective sub-unit to collectively track the verified threat;

sending a second wireless message relating to the verified threat to a monitoring system, wherein sending the second wireless message further comprises sending the second wireless message from the first sensor to the monitoring system via a relay operable to communicate wirelessly, where the relay does not comprise a sensor; and loading an analysis program into the relay and executing the analysis program to track the verified threat in response to the relay receiving the first message and joining the collective sub-unit, wherein the first wireless message is sent using a first communication protocol, the first communication protocol defining a first set of messages for identifying the possible threat, verifying the possible threat, mustering components into the collective sub-unit, and identifying desired functionality for one or more of the components in the collective sub-unit;

wherein the second wireless message is sent using a second communication protocol, the second communication protocol defining a second set of messages for reporting the verified threat, transmitting video or still images associated with the verified threat, and conditioning a response of the collective sub-unit to the verified threat; and wherein the first set of messages is distinct from the second set of messages.

20. A system comprising:

a plurality of sensors configured to communicate wirelessly; and a monitoring system configured to communicate with the sensors;

wherein:

a first sensor of the plurality of sensors is configured to sense information relating to a specified condition and send a first wireless message relating to the sensed information to a second sensor of the plurality of sensors;

the second sensor is configured to verify a possible threat associated with the specified condition and to notify the first sensor whether the possible threat has been verified;

at least one of the first and second sensors is configured, if the second sensor verifies the possible threat, to organize the first and second sensors along with one or more additional components into a collective sub-unit in the system;

the components in the collective sub-unit, including the first and second sensors, are configured to communicate and collectively track the verified threat; and at least one of the components in the collective sub-unit is configured to send a second wireless message relating to the verified threat to the monitoring system;

wherein the first sensor is configured to send the first wireless message using a first communication protocol, the first communication protocol defining a first set of messages for identifying the possible threat, verifying the possible threat, mustering components into the collective sub-unit, and identifying desired functionality for one or more of the components in the collective sub-unit;

wherein the at least one component in the collective sub-unit is configured to send the second wireless message using a second communication protocol, the second communication protocol defining a second set of messages for reporting the verified threat, transmitting video or still images associated with the verified threat, and conditioning a response of the collective sub-unit to the verified threat;

wherein the first set of messages is distinct from the second set of messages; and wherein the first sensor is further configured to:

receive a communication from a third sensor; and join a second collective sub-unit, wherein the second collective sub-unit comprises components configured to track a second threat.

* * * * *